United States Patent [19]

Young

[11] Patent Number: 4,515,528

[45] Date of Patent: May 7, 1985

[54] HYDROCARBON GETTER PUMP

[75] Inventor: James R. Young, Rexford, N.Y.

[73] Assignee: General Electric Company, Schenectady, N.Y.

[21] Appl. No.: 511,061

[22] Filed: Jul. 5, 1983

[51] Int. Cl.[3] ..... F04B 37/02

[52] U.S. Cl. ..... 417/51; 313/547; 313/555; 55/208; 423/245; 423/248; 417/53

[58] Field of Search ..... 417/48, 51, 53; 313/481, 547, 549, 554, 555, 561; 423/248, 245; 55/208

[56] References Cited

U.S. PATENT DOCUMENTS

| | | | |
|---|---|---|---|
| 1,911,780 | 5/1933 | White et al. | 423/248 |
| 3,167,678 | 1/1965 | Griessel | 417/51 X |
| 3,221,197 | 11/1965 | Coppola | 417/51 X |
| 3,427,253 | 2/1969 | Becker-Boost et al. | 423/245 R X |
| 3,630,690 | 12/1971 | Coppola | 313/547 X |
| 3,672,789 | 6/1972 | Young | 417/51 |
| 3,764,266 | 10/1973 | Murakami | 423/248 X |
| 3,780,501 | 12/1973 | Porta et al. | 417/51 X |
| 3,896,042 | 7/1975 | Anderson et al. | 423/248 X |
| 3,961,897 | 6/1976 | Giorgi et al. | 417/51 X |
| 3,979,166 | 9/1976 | Zucchinelli | 313/554 X |
| 4,174,954 | 11/1979 | Kusebanch et al. | 422/211 X |

*Primary Examiner*—W. L. Freeh
*Assistant Examiner*—Paul F. Neils
*Attorney, Agent, or Firm*—Mark L. Mollon; James C. Davis, Jr.; Marvin Snyder

[57] ABSTRACT

A hydrocarbon getter pump for use in sealed envelopes comprises an active metal alloy capable of gettering hydrogen, a nickel catalyst and means for heating the nickel catalyst and getter material from 300° to 500° centigrade. The heated catalyst dissociates the hydrocarbon into hydrogen and carbon. The getter material getters the hydrogen and the carbon is deposited on the surfaces of the catalyst.

5 Claims, 1 Drawing Figure

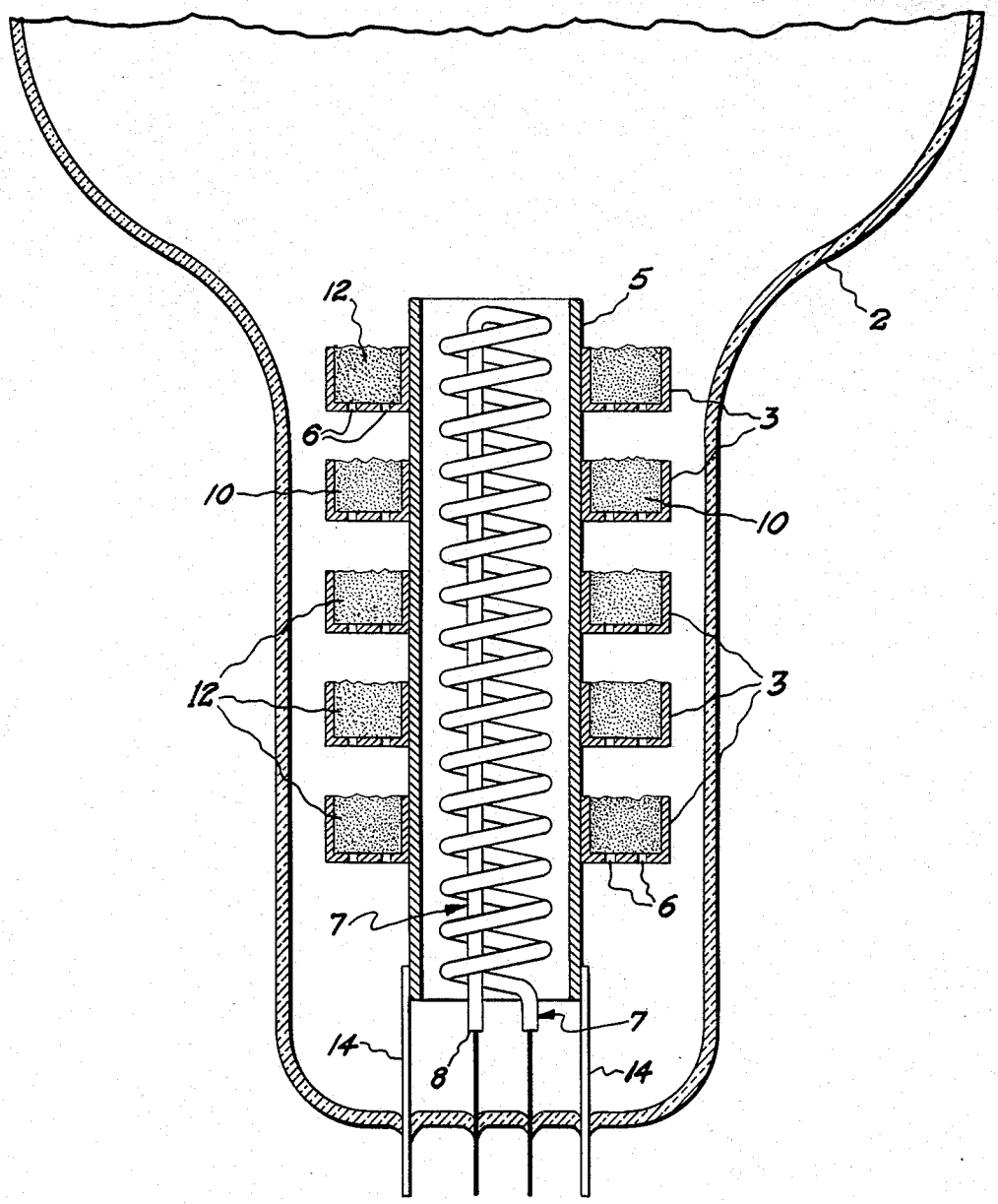
12
5
2
6
3
10
10
12
3
7
6
7
14
8
14

HYDROCARBON GETTER PUMP

BACKGROUND OF THE INVENTION

This invention relates to hydrocarbon getter pumps used to remove hydrocarbons from sealed envelopes and more particularly to a pump employing a catalyst and gettering material.

Sealed single beam oil film light valves used as a part of projection television systems, require removal of hydrogen, methane and heavy hydrocarbons resulting from electron bombardment by an electron beam of a thin oil film located in the tube. The heavy hydrocarbons are removed by a molecular sieve while the presently-used getter pump has a tungsten filament to generate electrons to dissociate the hydrocarbons by electron bombardment, into carbon and hydrogen. The hydrogen is gettered with an active metal alloy of 84% zirconium and 16% aluminum by weight, while the carbon is deposited on the surface of the electron bombardment chamber. The getter material is situated in ring shaped receptacles with the receptacles spaced apart in the axial direction by a wire frame. A tungsten heating element, positioned axially through the ring receptacles, is operated at high voltages to generate heat and electron bombardment. The electron bombardment getter pump has two drawbacks, however. First, the electron emission control electronics required to maintain electron bombardment as the tungsten filament ages is costly, and secondly, the electron emission filament becomes brittle after many hours of operation and may break or burn out if subjected to a small mechanical shock.

It is an object of the present invention to provide a hydrocarbon getter pump that does not use electron bombardment to dissociate hydrocarbons.

It is a further object of the present invention to provide a hydrocarbon getter pump that is mechanical shock resistant.

It is a still further object of the present invention to provide a hydrocarbon getter that does not need control electronics.

SUMMARY OF THE INVENTION

In one aspect of the present invention, a hydrocarbon getter pump for use in a sealed envelope having a vacuum or inert atmosphere comprises an active metal alloy capable of gettering hydrogen, a nickel catalyst and means for heating the getter material and the nickel catalyst from 300°–500° C. The heated catalyst dissociates the hydrocarbon into hydrogen and carbon so that the getter material can getter the hydrogen and the carbon can deposit on the surfaces of the catalyst.

BRIEF DESCRIPTION OF THE DRAWING

The features of the invention believed to be novel are set forth with particularity in the appended claims. The invention itself, however, both as to organization and method of operation, together with further objects and advantages thereof, may best be understood by reference to the following description taken in conjunction with the accompanying drawing in which the single FIGURE is a cross-sectional view of a hydrocarbon getter pump in accordance with the present invention.

DETAILED DESCRIPTION OF THE INVENTION

Referring to the FIGURE, the hydrocarbon getter pump suitable for insertion in a sealed envelope 2 such as the light valve tube described in Towlson's U.S. Pat. No. 3,385,991, issued May 28, 1968 and assigned to the instant assignee, is shown. U.S. Pat. No. 3,385,991 is hereby incorporated by reference. Ring shaped receptacles 3 surround a hollow cylinder 5 which can be fabricated of nickel or stainless steel. The receptacles can be affixed to the cylinder by spot welding, for example. The ring shaped receptacles are open on one side forming a circular channel and the bottom portion of the channel defines a plurality of apertures. The hollow cylinder 5 can contain apertures 6 to improve gas circulation in and around the cylinder. Situated in the hollow cylinder is an insulated electrical heating element 7 such as a Calrod ® element available from the General Electric Company. The electrical heating element is coated with insulating material 8, such as magnesium oxide, so that adjacent turns of heating element 7 do not short. At least one of the ring receptacles 3 contains a nickel catalyst 10 of powdered or granular passivated nickel. A suitable catalyst is available from Harshaw Chemical Co., Cleveland, Ohio as nickel catalyst 5132G. The other ring receptacles contain getter material 12 comprising a metallic alloy of approximately 84% zirconium and approximately 16% aluminum by weight. The getter material is available, for example, from SAES Getters Electronics, Inc., Colorado Springs, Colo. The heating element 7 is connected to a suitable source of electrical power and supplied typically with 10–15 watts of energy at 6–10 volts. The cylinder 5 is supported in the sealed envelope 2 by support wires 14 affixed to the cylinder by welding, for example, with the other ends of the support wires anchored in the glass envelope wall.

In operation, the getter material and nickel catalyst are heated in a vacuum or inert atmosphere to approximately 300°–500° C. by the heating element 7. Methane is dissociated by the activated nickel catalyst 10 to form hydrogen and carbon. The hydrogen diffuses away and is gettered by the heated getter material 12 and the carbon deposits on the surfaces of the catalyst 10. Heavier hydrocarbons would preferably be removed by a molecular sieve, not shown.

When the hydrocarbon getter pump is used in a light valve, the pump would be situated in an appendage to the tube with the molecular sieve positioned between the pump and the main tube body. The two filament leads extend through the tube wall to the tube exterior.

The foregoing describes a hydrocarbon getter pump for removing hydrocarbons from sealed envelopes which does not use electron bombardment to dissociate the hydrocarbons. The hydrocarbon getter pump of the present invention is mechanically shock resistant since no tungsten filament is employed, and does not need control electronics to control the heating element.

While the invention has been particularly shown and described with reference to a preferred embodiment thereof, it will be understood by those skilled in the art that various changes in form and details may be made without departing from the spirit and scope of the invention.

What is claimed is:

1. A hydrocarbon getter pump for use within a vacuum or inert atmosphere, comprising:

getter material comprising an active metal alloy capable of gettering hydrogen;

a nickel catalyst for dissociating hydrocarbons selected from the group consisting of powdered passivated nickel and granular passivated nickel; and means for heating said getter material and said nickel catalyst to approximately 300°–500° C.

2. The hydrocarbon getter pump of claim 1 wherein said metal alloy comprises substantially 84% zirconium and 16% aluminum by weight.

3. A hydrocarbon getter pump for use within a vacuum or inert atmosphere, comprising:

a hollow cylinder;

heating means situated in said cylinder;

a plurality of ring shaped receptacles surrounding said hollow cylinder;

a nickel catalyst for dissociating hydrocarbons; and getter material comprising an active metal alloy capable of gettering hydrogen, at least one of said receptacles having said nickel catalyst situated therein, the other of said receptacles having said getter material situated therein.

4. The hydrocarbon getter pump of claim 3 wherein said active metal alloy comprises substantially 84% zirconium and 16% aluminum by weight.

5. A method of removing hydrocarbons from a vacuum or inert atmosphere, comprising the steps of:

heating a nickel catalyst to approximately 300°–500° C. in the presence of hydrocarbons to dissociate said hydrocarbons into hydrogen and carbon; and gettering said hydrogen with an active metal alloy, allowing the carbon material to deposit on the surfaces of the catalyst.

* * * * *